US008771020B2

(12) United States Patent
Shih et al.

(10) Patent No.: US 8,771,020 B2
(45) Date of Patent: Jul. 8, 2014

(54) CONNECTOR ASSEMBLY

(71) Applicant: Hon Hai Precision Industry Co., Ltd., New Taipei (TW)

(72) Inventors: Chi-Tse Shih, New Taipei (TW); Chin-Feng Chen, New Taipei (TW); Tay-Yang Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/726,400

(22) Filed: Dec. 24, 2012

(65) Prior Publication Data

US 2013/0273783 A1 Oct. 17, 2013

(30) Foreign Application Priority Data

Apr. 16, 2012 (TW) ..... 101113533 U

(51) Int. Cl.
*H01R 24/00* (2011.01)

(52) U.S. Cl.
USPC ..... 439/660

(58) Field of Classification Search
USPC ..... 439/540.1, 638, 660
See application file for complete search history.

(56) References Cited

U.S. PATENT DOCUMENTS 6,113,396 A 9/2000 Tung
7,219,242 B2 5/2007 Goodman

FOREIGN PATENT DOCUMENTS

EP 1471371 A2 10/2004
WO 2010/047716 A1 4/2010
WO 2010/144756 A2 12/2010

*Primary Examiner* — Khiem Nguyen
(74) *Attorney, Agent, or Firm* — Novak Druce Connolly Bove + Quigg LLP

(57) ABSTRACT

A connector assembly includes a connector plug and a connector socket. The connector plug includes a first and a second plug signal transmitting pieces. A plurality of parallel first plug signal transmitting pins is laid on the first plug signal transmitting piece. A plurality of parallel second plug signal transmitting pins is laid on the second plug signal transmitting piece. The connector socket includes a lower portion which includes a first receiving slot and a second receiving slot. A plurality of first socket signal transmitting lines is placed in the first receiving slot. A plurality of second socket signal transmitting lines is placed in the second receiving slot. The connector plug inserts in the connector socket to connect the first plug signal transmitting pins to the first socket signal transmitting pins, and simultaneously connect the second plug signal transmitting pins to the second socket signal transmitting pins.

14 Claims, 2 Drawing Sheets

CONNECTOR ASSEMBLY

BACKGROUND

1. Technical Field

The present disclosure relates to connector assemblies that can transmit a plurality of signals.

2. Description of Related Art

Connectors are widely used in electronic devices to transmit signals. For transmitting different signals, the electronic device often uses different connectors, and each connector transmits one kind of signal. Therefore, a plurality of different types of connectors must be mounted on the electronic device, which has a high cost and consumes a lot of space in the electronic device.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
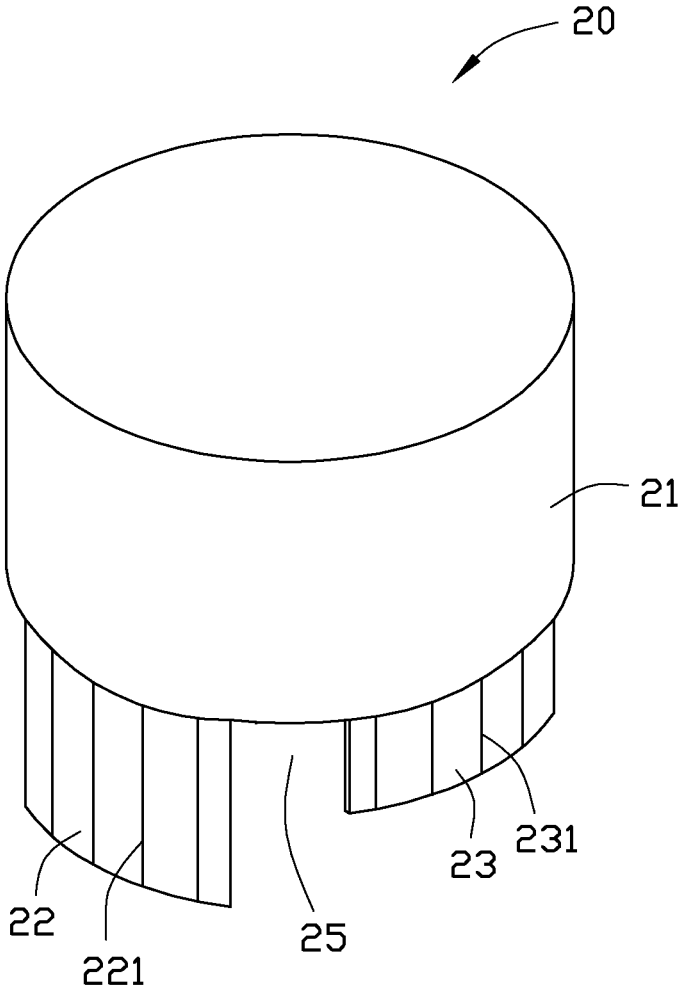
FIG. 1 is a sketch view of a connector plug of a connector assembly in accordance with an embodiment.
Figure 2:
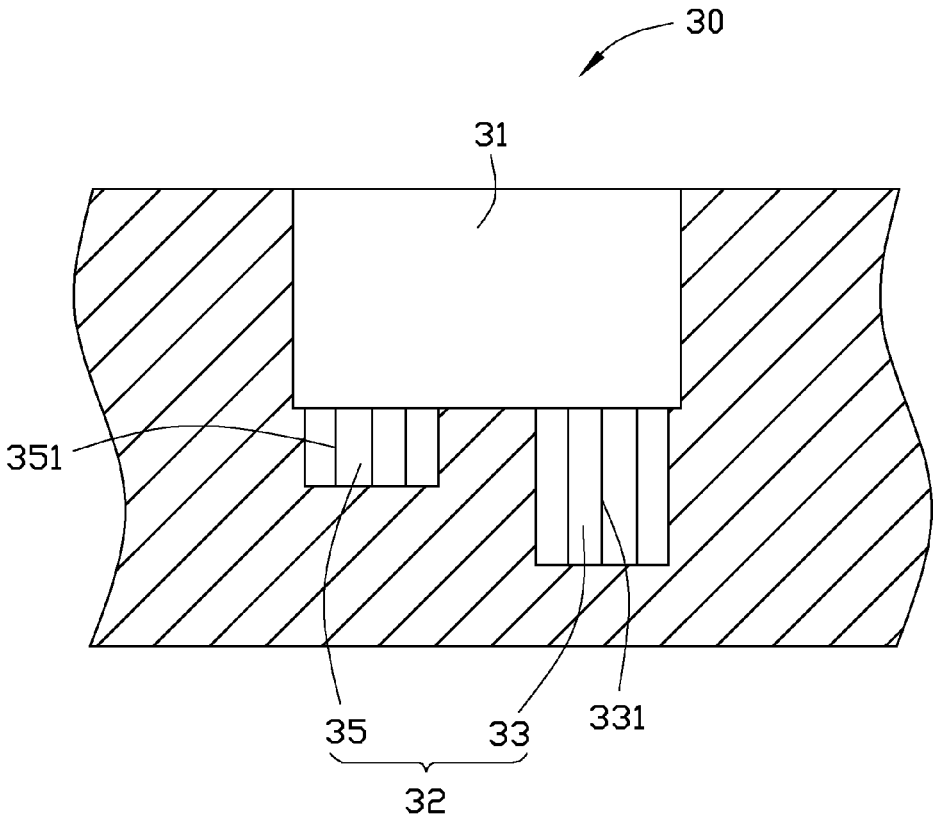
FIG. 2 is a sectional view of a connector socket of the connector assembly of FIG. 1.

FIGS. 1 and 2 show a connector assembly in accordance with an embodiment. The connector assembly includes a connector plug 20 and a connector socket 30.

FIG. 1 shows that the connector plug 20 includes a post 21. A bottom edge of the post 21 extends downward to form a plurality of signal transmitting pieces. In one embodiment, the plurality of signal transmitting pieces includes a first plug signal transmitting piece 22 and a second plug signal transmitting piece 23. A height of the first plug signal transmitting piece 22 is larger that of the second plug signal transmitting piece 23. A gap 25 is located between the first plug signal transmitting piece 22 and the second plug signal transmitting piece 23 to separate the first plug signal transmitting piece 22 from the second plug signal transmitting piece 23. Both of the first plug signal transmitting piece 22 and the second plug signal transmitting piece 23 are cambered piece.

A plurality of parallel first plug signal transmitting lines 221 are laid on the first plug signal transmitting piece 22. The plurality of first plug signal transmitting lines 221 extend in an axial direction of the post 21. The plurality of first plug signal transmitting lines 221 transmit a first signal, such as a USB signal.

A plurality of parallel second plug signal transmitting lines 231 are laid on the second plug signal transmitting piece 23. The plurality of second plug signal transmitting lines 231 also extend in the axial direction of the post 21. The plurality of second plug signal transmitting lines 231 transmit a second signal, such as an AGP signal.

FIG. 2 shows that the connector socket 30 receives the connector plug 20. The connector socket 30 is substantially hollow with a shape which matches that of the connector plug 20. The connector socket 30 includes an upper portion 31 adapted to receive the post 21 and a lower portion 32. The lower portion 32 includes a first receiving slot 33 adapted to receive the first plug signal transmitting piece 22 and a second receiving slot 35 adapted to receive the second plug signal transmitting piece 23. A depth of the first receiving slot 33 is larger than that of the second receiving slot 35.

A plurality of first socket signal transmitting lines 331 is placed in the first receiving slot 33. The plurality of first socket signal transmitting lines 331 transmit the first signal. A plurality of second socket signal transmitting lines 351 is placed in the second receiving slot 35. The plurality of second socket signal transmitting lines 351 transmit the second signal.

To join the connector plug 20 and the connector socket 30, the first plug signal transmitting piece 22 is aligned to the first receiving slot 33 and the second plug signal transmitting piece 23 is aligned to the second receiving slot 35. The connector plug 20 is inserted in the connector socket 30. The post 21 of the connector plug 20 is received in the upper portion 31. The first plug signal transmitting piece 22 is received in the first receiving slot 33. The second plug signal transmitting piece 23 is received in the second receiving slot 35. The first plug signal transmitting lines 221 are coupled to the first socket signal transmitting lines 331. The second plug signal transmitting lines 231 are coupled to the second socket signal transmitting lines 351. The connector plug 20 and the connector socket 30 can thus exchange two different kinds of signal simultaneously, and with each type of signal independent of the others.

In another embodiment, the connector plug 20 and the connector socket 30 can provide connections to enable the exchange of three, four, five or more different kinds of signals.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A connector assembly, comprising:

a connector plug comprising a first plug signal transmitting piece and a second plug signal transmitting piece; a plurality of parallel first plug signal transmitting pins that are laid on the first plug signal transmitting piece, and a plurality of parallel second plug signal transmitting pins that are laid on the second plug signal transmitting piece; and a connector socket comprising a lower portion, the lower portion comprises a first receiving slot and a second receiving slot, a plurality of first socket signal transmitting lines placed in the first receiving slot, and a plurality of second socket signal transmitting lines placed in the second receiving slot;

wherein the connector plug is configured to insert in the connector socket to place the first plug signal transmitting piece into the first receiving slot to connect the plurality of first plug signal transmitting pins to the plurality of first socket signal transmitting lines to transmit a first signal, and simultaneously place the second plug signal transmitting piece into the second receiving slot to connect the plurality of second plug signal transmitting pins to the plurality of second socket signal transmitting lines to transmit a second signal.

2. The connector assembly of claim 1, wherein the connector plug further comprises a post, the first plug signal transmitting piece and the second plug signal transmitting piece are connected to a bottom edge of the post; and the connector plug further comprises an upper portion located above the lower portion, and the post is configured to insert in the upper portion when the connector plug is inserted in the connector socket.

3. The connector assembly of claim 2, wherein the plurality of parallel first plug signal transmitting pins and the plurality of parallel second plug signal transmitting pins extends in an axial direction of the post.

4. The connector assembly of claim 1, wherein a gap is located between the first plug signal transmitting piece and the second plug signal transmitting piece to separate the first plug signal transmitting piece from the second plug signal transmitting piece.

5. The connector assembly of claim 1, wherein a height of the first plug signal transmitting piece is larger that of the second plug signal transmitting piece, and a depth of the first receiving slot is larger than that of the second receiving slot.

6. The connector assembly of claim 1, wherein both of the first plug signal transmitting piece and the second plug signal transmitting piece are cambered.

7. The connector assembly of claim 1, wherein the first signal is an USB signal, and the second signal is an AGP signal.

8. A connector assembly, comprising:

a connector plug comprising a first plug signal transmitting piece and a second plug signal transmitting piece, and a height of the first plug signal transmitting piece is larger that of the second plug signal transmitting piece; and a connector socket comprising a lower portion, the lower portion comprises a first receiving slot and a second receiving slot, and a depth of the first receiving slot is larger than that of the second receiving slot;

wherein the connector plug is configured to insert in the connector socket to place the first plug signal transmitting piece into the first receiving slot to transmit a first signal, and simultaneously place the second plug signal transmitting piece into the second receiving slot to transmit a second signal.

9. The connector assembly of claim 8, wherein a plurality of parallel first plug signal transmitting pins is laid on the first plug signal transmitting piece, a plurality of parallel second plug signal transmitting pins is laid on the second plug signal transmitting piece; a plurality of first socket signal transmitting lines is placed in the first receiving slot, a plurality of second socket signal transmitting lines is placed in the second receiving slot; the plurality of parallel first plug signal transmitting pins is configured to couple the first socket signal transmitting lines to transmit the first signal; and the plurality of parallel second plug signal transmitting pins is configured to couple the second socket signal transmitting lines to transmit the second signal.

10. The connector assembly of claim 9, wherein the connector plug further comprises a post, the first plug signal transmitting piece and the second plug signal transmitting piece are connected to a bottom edge of the post; and the connector plug further comprises an upper portion located above the lower portion, and the post is configured to insert in the upper portion when the connector plug is inserted in the connector socket.

11. The connector assembly of claim 10, wherein the plurality of parallel first plug signal transmitting pins and the plurality of parallel second plug signal transmitting pins extends in an axial direction of the post.

12. The connector assembly of claim 8, wherein a gap is located between the first plug signal transmitting piece and the second plug signal transmitting piece to separate the first plug signal transmitting piece from the second plug signal transmitting piece.

13. The connector assembly of claim 8, wherein both of the first plug signal transmitting piece and the second plug signal transmitting piece are cambered.

14. The connector assembly of claim 8, wherein the first signal is an USB signal, and the second signal is an AGP signal.

* * * * *